US006041437A

United States Patent [19]

Barker et al.

[11] Patent Number: 6,041,437

[45] Date of Patent: Mar. 28, 2000

[54] WATERPROOF THERMAL INSERT FOR OUTDOOR SPORTS PANTS

[76] Inventors: Edward C. Barker, 1177 Victory Chapel Rd., Dover, Del. 19904; Brian L. Gay, 580 Norman Rd.; John D. Brenner, 1601 Druck Valley Rd., both of York, Pa. 17402

[21] Appl. No.: 09/311,728

[22] Filed: May 14, 1999

Related U.S. Application Data

[60] Provisional application No. 60/088,601, Jun. 9, 1998.

[51] Int. Cl.[7] ..... A41B 11/00; A41D 13/00

[52] U.S. Cl. ..... 2/82; 2/467; 2/23; 2/228; 2/227; 156/278; 252/70; 428/308.4

[58] Field of Search ..... 2/455, 456, 458, 2/466, 23, 82, 401, 231, 267, 268, 272, 275, 911, 919, 238, 227, 228, 247, 250; 156/278; 428/308.4

[56] References Cited

U.S. PATENT DOCUMENTS

| | | | |
|---|---|---|---|
| 4,805,243 | 2/1989 | Gibbens et al. | 2/228 |
| 4,894,867 | 1/1990 | Ceravolo et al. . | |
| 4,907,295 | 3/1990 | Yasuda . | |
| 4,993,077 | 2/1991 | Robison . | |
| 5,038,408 | 8/1991 | DeBaene . | |
| 5,068,920 | 12/1991 | Bray . | |
| 5,214,804 | 6/1993 | Carey et al. | 2/206 |
| 5,625,895 | 5/1997 | Sovereign | 2/467 |
| 5,634,215 | 6/1997 | DeBaene . | |
| 5,637,389 | 6/1997 | Colvin et al. | 426/109 |
| 5,649,328 | 7/1997 | Martin . | |
| 5,851,338 | 12/1998 | Pushaw | 156/278 |
| 5,885,475 | 3/1999 | Salyer | 252/70 |

FOREIGN PATENT DOCUMENTS

| | | |
|---|---|---|
| 1583447 | 1/1981 | United Kingdom . |
| 1599555 | 10/1981 | United Kingdom . |

*Primary Examiner*—John J. Calvert
*Assistant Examiner*—Robert Muromoto, Jr.
*Attorney, Agent, or Firm*—Richard C. Litman

[57] ABSTRACT

A waterproof thermal insert for outdoor sport pants which is sewn into the rear of a pair of pants from the belt line to the region between the middle of the thigh to the back of the knee, from each outside seam to inside seam, and from the inside seam to the crotch. The insert is composed of three layers: (1) an outside layer of water repellant, closed cell foam neoprene; (2) a middle layer of a synthetic, thermal insulating fabric, such as Outlast® Zermatt; and (3) a soft, flexible material, such as polar fleece. The three layers are sewn together. If additional protection is desired at the sewn seams, the seams may be heat sealed with an overlay of thermoplastic tape. Alternatively, the insert may be composed of two layers: (1) an outside layer of water repellant, closed cell foam neoprene; and (2) an inner layer of a composite fabric combining a synthetic, thermal insulating material with a soft, flexible material, viz., Outlast® Glacier or Outlast® Glenpile.

9 Claims, 3 Drawing Sheets

WATERPROOF THERMAL INSERT FOR OUTDOOR SPORTS PANTS

CROSS-REFERENCE TO RELATED APPLICATION

This application claims the benefit of U.S. Provisional Patent Application Ser. No. 60/088,601, filed Jun. 9, 1998.

BACKGROUND OF THE INVENTION

1. Field of the Invention

The present invention relates to outdoor garments and sports wear, and particularly to a waterproof or water resistant thermal insert for the seat area of lightweight pants providing warmth and protection from moisture.

2. Description of Related Art

Various sports, such as hunting, fishing, hiking, camping, etc. involve spending long hours outdoors, often in the early morning hours, and entailing exposure to cold, wet weather and long periods of sitting in dew moistened grass and underbrush while waiting to catch sight of game. Traditional hunting pants are often heavy, bulky, and noisy, tending to tire the hunter by the time he arrives at his destination, or making him sweaty from having too much clothing on. Heated cushions, such as those made from polystyrene and other plastics, provide some warmth and comfort, but tend to be noisy, slippery when sitting on inclines, and inconvenient to carry. Foam cushions are quieter, but do not provide warmth for the buttock area. What is needed is a means for providing lightweight pants with thermal and waterproof or water resistant protective insert for the seat of the pants and the back of the thighs.

Various attempts have been made to provide sportswear and outdoor garments with inserts or multiple layers for one or more purposes. U.S. Pat. No. 4,894,867, issued Jan. 23, 1990 to Cervalo, et al., discloses shorts with a slit in the outside of the leg temporarily secured by a hook and loop fastener, which may be equipped with flexible padding comprising a wear resistant lining and foam rubber interior, the padding being placed in the rear right-hand and left-hand quarters and extending into the leg portions, in order to provide protection when sliding into bases.

U.S. Pat. No. 5,649,328, issued Jul. 22, 1997 to Eugene C. Martin, describes a Shock Absorbent Abrasion Resistant Sports Garment, being a pair of shorts for in-line skating having inner and outer shorts. The outer shorts have pockets for inserting padding, while the inner shorts have pads with three layers: an inner layer of polyester-nylon blend, a middle layer of high density open cell foam, and an outer layer of nylon tricot.

United Kingdom Patent No. 1,583,447, published Jan. 28, 1981, teaches a one-piece survival suit made from warp knitted nylon fabric, transfer-coated with polyurethane, in which the seams are sewn and subsequently sealed by high frequency welding.

A general All Weather Garment for snow weather is shown in U.S. Pat. No. 4, 993,077, issued Feb. 19, 1991 to Maurice L. Robison. The garment has three layers, the middle layer comprising four panels of waterproof textile fabrics of nylon fibers, at least one side being coated with a thermoplastic resin such as PVC, the panels fastened by heat sealing the seams to prevent moisture seepage, the side seams of the panels being sewn to the inner layer of the garment.

Work Pants, primarily for use by roofers, are shown in U.S. Pat. No. 5,038,408, issued Aug. 13, 1991, and U.S. Pat. No. 5,634,215, issued Jun. 3, 1997, both patents issued to David N. DeBaene. The '408 patent describes pants having a rear panel formed from a single piece of leather. The '215 patent discloses pants with a seat having overlay panels made from a blended weave of nylon and polypropylene with a polyurethane coating for waterproofing and neoprene foam pads at the knees with a polyurethane coating.

A variety of layer garments have been used to improve clothing for water sports. U.S. Pat. No. 4,907,295, issued Mar. 13, 1990 to Mamoru Yasuda, teaches a diving suit with pads in the hip and thigh areas sewn between and inner and outer shell, the pads being neoprene foam, the inner shell being PVC and a fabric of natural or synthetic fiber, and the outer shell being a resin coated cloth.

U.S. Pat. No. 5,068,920, issued Dec. 3, 1991 to Robert D. Bray, describes a dry suit for water skiing made of nylon fabric having a polyurethane interior coating, having a patch on the exterior of the seat made from nylon 1 or 2 neoprene, which is a 1.5 mm layer of neoprene with either 1 or 2exterior skins of nylon or Lycra® spandex laminated together. The patch is adhesively secured with neoprene cement over the entire surface, and stitched to the suit at the outer perimeter, preferably at the side seams.

United Kingdom Patent No. 1,599,555, published Oct. 7, 1981, shows a material for diving suits comprising a layer of stretchable synthetic woven material having an impervious skin of a synthetic plastic material and a layer of open celled foam elastomeric material, and may also have a layer of extensible toweling fabric.

None of the above inventions and patents, taken either singly or in combination, is seen to describe the instant invention as claimed. In particular, none of the above are seen to comprise an insert for the seat and thigh area of a lightweight pair of pants, including an outer waterproof layer and an inner layer of temperature regulating fabric for warmth and comfort. Therefore, there is a need for the thermal insert for outdoor sports pants of the present invention.

SUMMARY OF THE INVENTION

The present invention is a waterproof thermal insert for outdoor sport pants which is sewn into the rear of a pair of pants from the belt line to the region between the middle of the thigh to the back of the knee, from each outside seam to inside seam, and from the inside seam to the crotch. The insert is composed of three layers: (1) an outside layer of water repellant, closed cell foam neoprene; (2) a middle layer of a synthetic, thermal insulating fabric, such as Outlast® Zermatt; and (3) a soft, flexible material, such as polar fleece. The three layers are sewn together. If additional protection is desired at the sewn seams, the seams may be heat sealed with an overlay of thermoplastic tape. In an alternative embodiment, the insert may be composed of two layers: (1) an outside layer of water repellant, closed cell foam neoprene; and (2) an inner layer of a composite fabric combining a synthetic, thermal insulating material with a soft, flexible material, viz., Outlast® Glacier or Outlasts Glenpile.

Accordingly, it is a principal object of the invention to provide a waterproof or water resistant thermal insert which can be sewn into the seat and back of the thigh area of lightweight sports pants to furnish the sportsman with protection from exposure to moist, cold ground conditions and to provide comfort while sitting for extended periods of time.

It is another object of the invention to free the outdoor sportsman from the necessity of wearing bulky clothing and carrying around foam or heated cushions by providing a comfortable and flexible insert which may be sewn into lightweight pants to furnish protection in chilly and damp weather.

It is a further object of the invention to provide a waterproof thermal insert for lining the seat and thigh area of pants including a temperature regulated inner layer, and a waterproof or water repellant outer layer.

Still another object of the invention is to provide a lightweight thermal insert which keeps the individual warm and dry without the necessity while avoiding excessive overheating caused by heavy and bulky clothing.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a lightweight, waterproof or water resistant thermal insert for outdoor sports pants which helps to provide protection and comfort in moist and cold weather. While the invention had its genesis in the experience of hunters seeking some convenient means of keeping their hindquarters warm and dry while sitting or walking outdoors, the insert is also useful for hikers, campers, fishermen, nature lovers, or virtually any application involving exposure to the elements.

Figure 1:
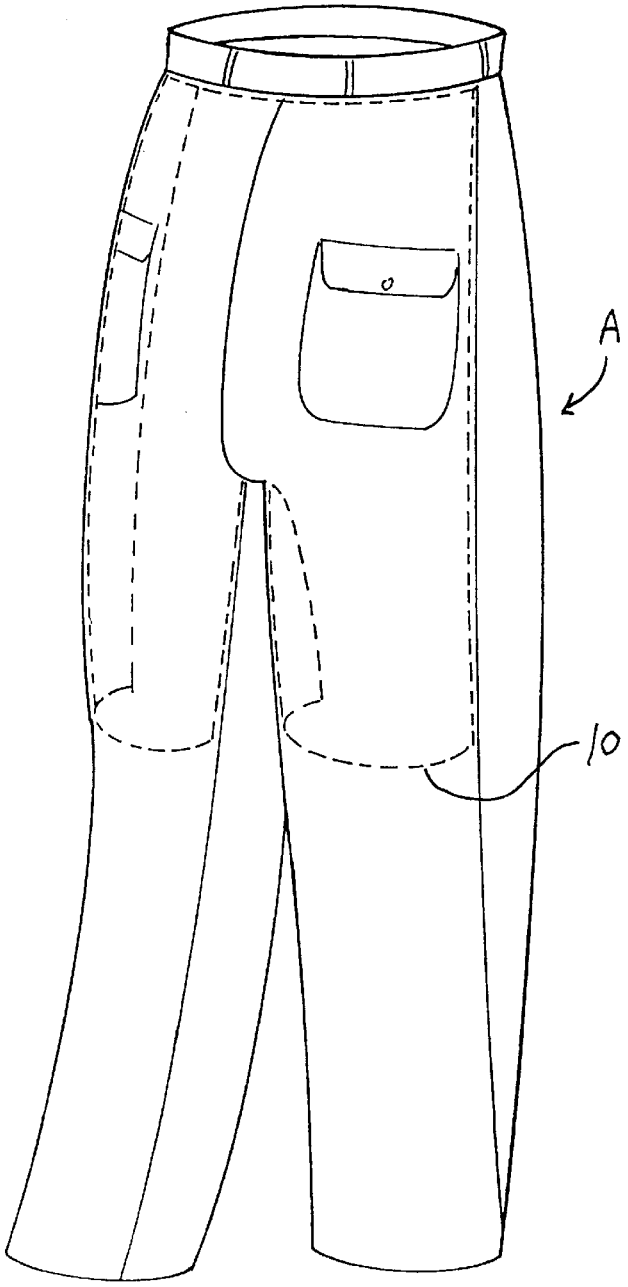
FIG. 1 is an environmental, perspective view of a waterproof thermal insert for outdoor sports pants according to the present invention.
Figure 2:
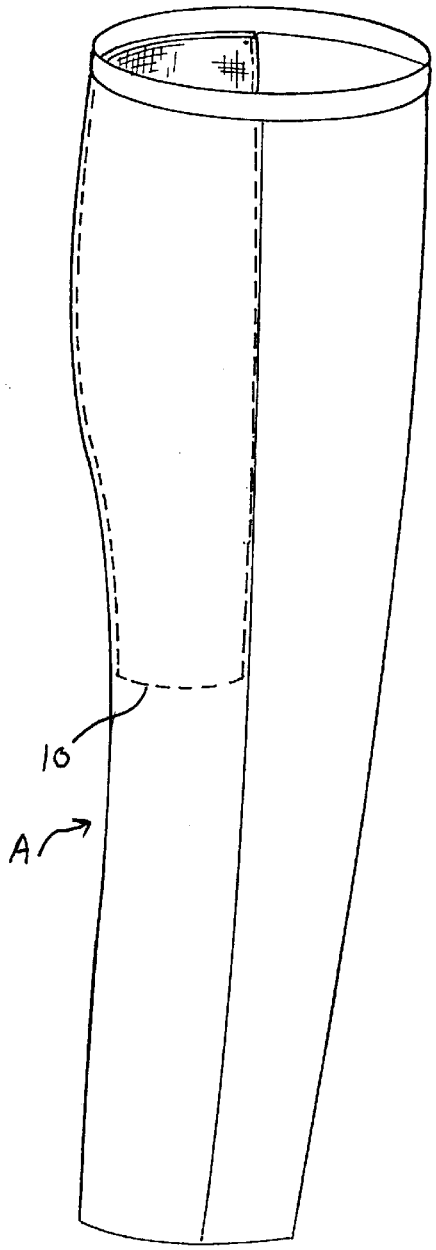
FIG. 2 is a side, environmental view of the waterproof thermal insert for outdoor sports pants according to the present invention.
Figure 3:
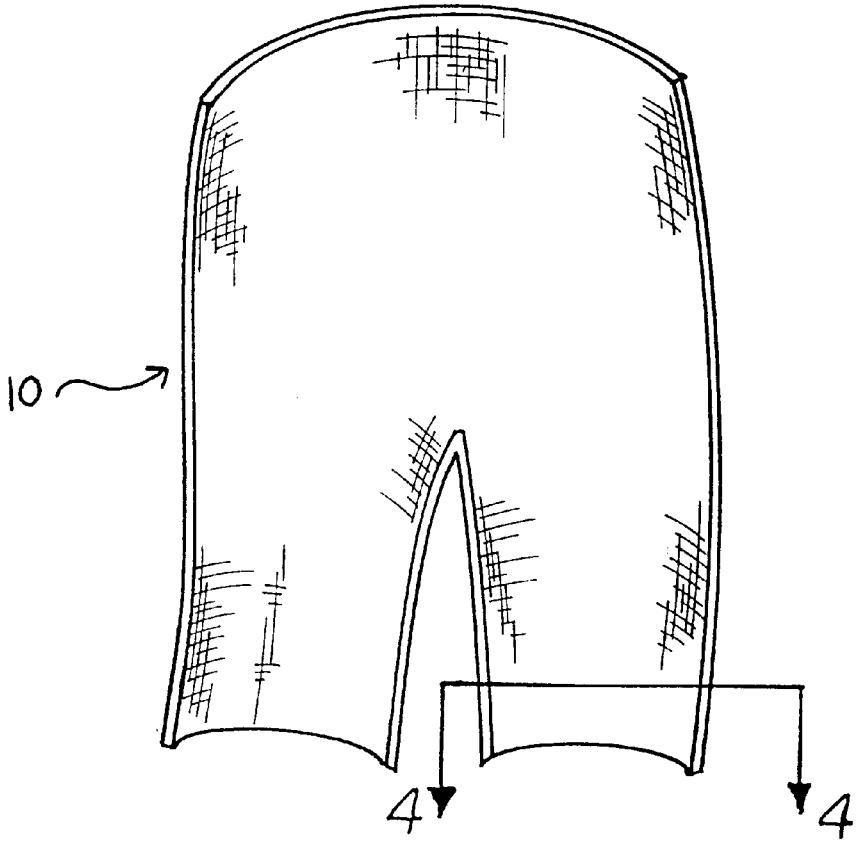
FIG. 3 is a front view of the waterproof thermal insert, according to the present invention.

FIGS. 1 through 3 show perspective views of the thermal insert according to the present invention, designated generally as 10 in the drawings. As shown in the drawings, the waterproof thermal insert 10 is a fabric which is sewn into the rear of a pair of pants A from the belt line down to the region from the middle of the thigh to the back of the knee, from each outside seam to inside seam, and from the inside seams to the crotch. The insert 10 is no more than ½ inch to 1 inch in thickness and weighs no more than about 1 pound. The insert 10 is warm, waterproof, and washable.

Figure 4:
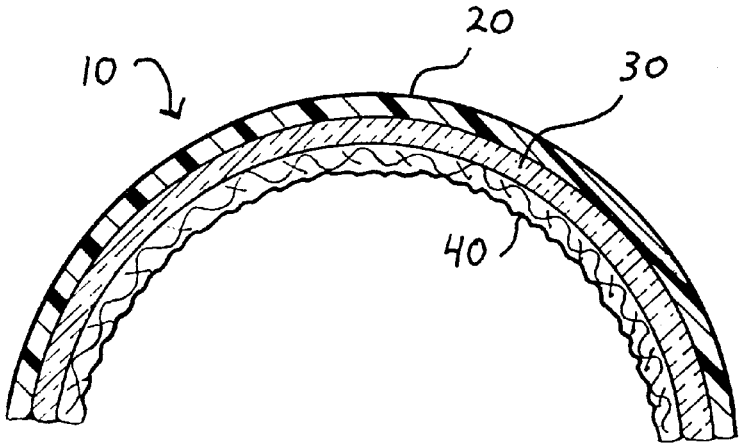
FIG. 4 is a sectional view along the line 4—4 of FIG. 3.

FIG. 4 shows a sectional view of the insert 10. The outer layer 20 consists of closed cell foam neoprene. The neoprene layer 20 presents a water repellant barrier on the outside of the insert 10, providing protection from moisture.

The middle layer 30 is a synthetic, thermally insulated fabric, preferably Outlast® Zermatt. Outlast fabrics, made by Outlast Technologies, Inc., are advertised as Temperature Regulating Fibers and Fabrics, and include a plurality of microencapsulated paraffinic hydrocarbons or phase change materials incorporated in the fibers to improve the absorption and release of heat. Other examples of fabrics which may be used for the middle layer 30 include Gore-Tex and several fabrics from Dupont, including Lycra® spandex, Thermax, and Thermostat. The properties of the fabric used for the middle layer 30 are such that the fabric should absorb heat generated during vigorous activities, such as hiking or walking over hilly terrain, and release the heat gradually upon sedentary activities.

The inner layer 40 consists of a soft, flexible fabric to provide a comfortable feel, some padding, and to lend flexibility to the material. Polar fleece is a soft, fluffy, wool-like material suitable for the inner layer 40.

The three layers are sewn together to form the insert 10, and the insert 10 is sewn to the rear seams of the pants A. In order to preserve the waterproof or water repellant properties of the insert 10, the seams may be heat sealed with a tape of thermoplastic material. When incorporated in a lightweight pair of pants A, such as camouflage pants, the insert 10 provides a lightweight, comfortable, warm, dry layer of protection to the seat and thigh area scarcely noticeable from the exterior of the pants A.

Figure 5:
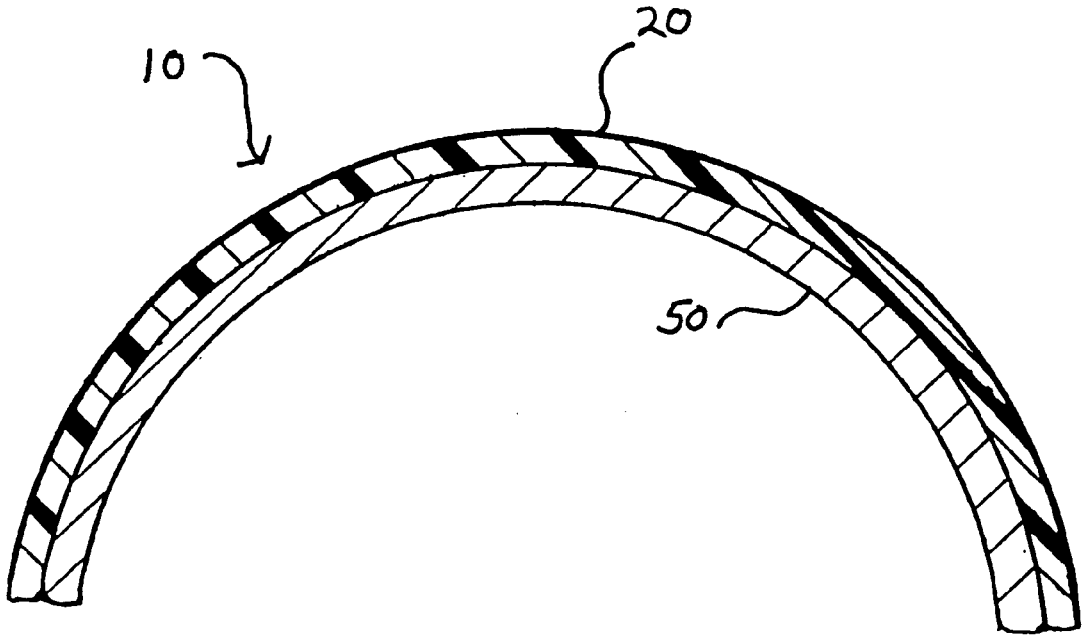
FIG. 5 is a sectional view of an alternative embodiment of a waterproof thermal insert according to the present invention.

FIG. 5 shows a section view of an alternative embodiment of the waterproof thermal insert 10 from a similar viewpoint as FIG.4. In FIG. 5, the outer layer 20 consists of closed cell foam neoprene as described above. The inner layer 50 is a composite material combining a synthetic, thermally insulated material with a soft, flexible fiber for comfort, for example, Outlast® Glacier or Outlast® Glenpile. Outlast Glacier includes a layer of a temperature regulating fabric having a plurality of microencapsulated paraffinic hydrocarbons or phase change materials incorporated into synthetic fibers to improve the absorption and release of heat, this layer being coated with fibers of 100% polyester fleece, which essentially incorporates the middle layer 30 and the inner layer 40 of the first embodiment into the single layer 50. Outlast Glenpile is a composite fabric composed of 50% Outlast acrylic fibers and 50% polyester fibers interwoven to form a soft pile fabric which incorporates the temperature regulating benefits of a synthetic fiber having phase change materials incorporated therein.

The two layers 20 and 50 are sewn together to form the insert 10, with the fleece or pile side of the inner layer 50 forming an outer surface, and the insert 10 is sewn to the rear seams of the pants A as described above. In order to preserve the waterproof or water repellant properties of the insert 10, the seams may be heat sealed with a tape of thermoplastic material. Advantageously, the alternative embodiment is even less bulky and lighter in weight than the embodiment including three layers, while having the same water resistant, temperature regulating, and comfort properties as the first embodiment described above.

It is to be understood that the present invention is not limited to the sole embodiments described above, but encompasses any and all embodiments within the scope of the following claims.

We claim:

1. A waterproof thermal insert for outdoor sport pants, comprising:

a) an outer layer, the outer layer being composed of water repellant material;

b) a middle layer, the middle layer being composed of a synthetic fabric having fibers containing a plurality of microencapsulated paraffins hydrocarbon phase change materials; and c) an inner layer, the inner layer being composed of a fabric having the properties of being soft to the touch and flexibility;

d) wherein said layers include seams sewn together at the edges of the layers;

e) wherein the insert is adapted for being sewn into the rear of a pair of pants from the belt line to the region between the middle of the thigh to the back of the knee, from the outside seams to the inside seams, and from the inside seams to the crotch.

2. The waterproof thermal insert according to claim 1, wherein said outer layer is made from closed cell foam neoprene.

3. The waterproof thermal insert according to claim 1, wherein said inner layer is made from polar fleece.

4. The waterproof thermal insert according to claim 1, wherein the seams of said insert are heat sealed by an overlay of thermoplastic tape.

5. A waterproof thermal insert for outdoor sport pants, comprising:

a) an outer layer, the outer layer being composed of water repellant material; and b) an inner layer, the inner layer being a composite fabric composed of a synthetic fiber containing a plurality of microencapsulated paraffins hydrocarbon phase change materials combined with a fiber having the properties of softness to the touch and flexibility;

c) wherein said layers include seams sewn together at the edges of the layers;

d) wherein the insert is adapted for being sewn into the rear of a pair of pants from the belt line to the region between the middle of the thigh to the back of the knee, from the outside pant seams to the inside pant seams, and from the inside pant seams to the crotch.

6. The waterproof thermal insert according to claim 5, wherein said outer layer is made from closed cell foam neoprene.

7. The waterproof thermal insert according to claim 5, wherein said inner layer is made from a fabric having a layer composed of fibers containing a plurality of microencapsulated paraffinic hydrocarbon phase change materials which is coated with a polyester fleece.

8. The waterproof thermal insert according to claim 5, wherein said inner layer is made from a composite fabric composed of synthetic fibers containing a plurality of microencapsulated paraffinic hydrocarbon phase change materials interwoven with polyester fibers to form a pile fabric.

9. The waterproof thermal insert according to claim 5, wherein the seams of said insert are heat sealed by an overlay of thermoplastic tape.

* * * * *